United States Patent [19]

Beatty

[11] Patent Number: 4,516,756

[45] Date of Patent: May 14, 1985

[54] PLASTIC SHEATH FOR FENCING

[76] Inventor: Gary L. Beatty, 450 S. Mason St., Harrisonburg, Va. 22801

[21] Appl. No.: 503,620

[22] Filed: Jun. 13, 1983

[51] Int. Cl.[3] ..... E04H 17/00

[52] U.S. Cl. ..... 256/1; 256/19

[58] Field of Search ..... 256/19, 1

[56] References Cited

U.S. PATENT DOCUMENTS

| | | | |
|---|---|---|---|
| 2,545,845 | 3/1951 | Du Batto et al. | 256/19 |
| 3,080,149 | 3/1963 | Pilboue | 256/19 X |
| 3,267,805 | 8/1966 | Ackerman | 350/105 |
| 3,957,250 | 5/1976 | Murphy | 256/19 |
| 4,181,764 | 1/1980 | Totten | 256/19 X |

*Primary Examiner*—Andrew V. Kundrat

[57] ABSTRACT

A finished hollow synthetic plastic fence element in the form of a sheath whose internal dimensions are congruent with the external dimensions of an unfinished fence core element, whereby the sheath can be slipped over the core element.

4 Claims, 3 Drawing Figures

PLASTIC SHEATH FOR FENCING

BACKGROUND OF THE INVENTION

1. Field of the Invention

This invention relates generally to fences and exterior posts and, more particularly, to a durable plastic sheath for covering a less durable fence or post element, such as a picket or rail, made of wood, for example.

2. Description of the Prior Art

A typical wood fence consists of wood elements, such as pickets, rails and posts, which are quite smoothly finished in order to present a pleasing appearance. Before or after installation, the fence elements are generally painted or treated further to improve their appearance and also to protect them from weathering and rotting from effects of rain, sunshine, wind, fungus etc. Of course, as the paint or other treating material on the exposed portion of the fence element wears, the elements must be periodically repainted or treated.

The cost of maintenance and up-keep of wood fencing has resulted in a reluctance to employ such fencing even though it may be more esthetically attractive than other types of fencing such as chain link fencing or other metal fencing.

There is known in the prior art a solid plastic picket which, of course, is durable but which is also very expensive. There is also known in the prior art the concept of painting or coating a fence post or guard rail with a plastic material, but such a paint coating eventually wears off and also requires the manual labor of actually painting the fence element.

Thus, there is a need for a durable and inexpensive fence element which also presents a pleasing appearance and which would permit the typical home owner to install maintenance-free picket or fail fencing and posts.

SUMMARY OF THE INVENTION

Therefore, the object of this invention is to provide picket or rail fencing that is virtually maintenance free and, thus, avoids the inconvenience and cost of up-keep that are normally associated with wood fencing.

Another object is to provide a durable fence element that enjoys the appearance of high grade natural wood while at the same time utilizing a lower grade of wood in its production and thus having a cheaper cost of wood. Furthermore, the fence element would not require initial painting or periodic repainting, while at the same time presenting a pleasing appearance.

A more specific object of my invention is to provide a hollow sheath of synthetic plastic material, made in various standard sizes, and which can be placed over either a new roughly hewn wood fence element or over an existing standard post element already installed in the ground.

Another object of my invention is to provide a fence element consisting of an unpainted, roughly hewn wood picket, for example, entirely encased in a rigid hollow polyvinyl chloride sheath which is molded with the desired color pigment therein.

DETAILED DESCRIPTION OF THE PREFERRED EMBODIMENTS

Figure 1:
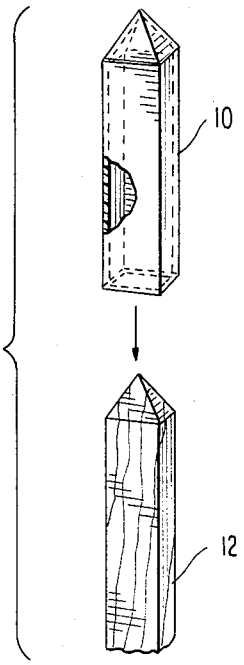
FIG. 1 illustrates a perspective view of my hollow plastic sheath and the manner in which it is inserted over a fence picket.

As shown in FIG. 1, in one form of my new fencing element, a hollow plastic sheath 10, closed at its upper pointed end, has dimensions and a shape which are congruent with a wood picket fence element 12 so that the plastic sheath can be easily slipped over the picket.

Figure 2:
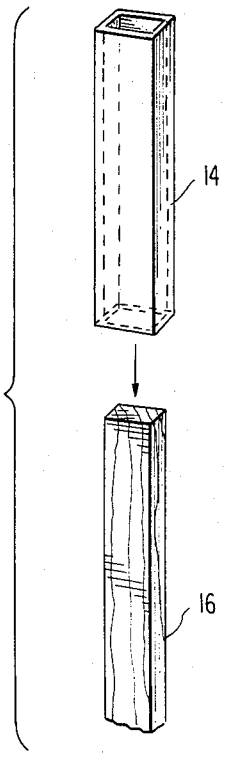
FIG. 2 illustrates a perspective view of another form of my plastic sheath and the manner in which it is inserted over a fence board.

In FIG. 2, the plastic sheath 14 is open at both ends and has a generally rectangular configuration congruent with that of the wood fence board 16 so that the sheath again can be easily slipped over the board. This embodiment of the invention would be used for a horizontal board which is to be attached between two fence posts.

Figure 3:
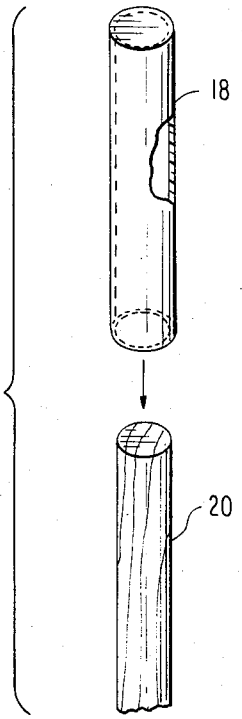
FIG. 3 illustrates still another form of my plastic sheath and the manner in which it is inserted over a round fence post.

FIG. 3 shows a sheath of generally circular and cylindrical configuration which permits it to be slipped over a round fence post 20.

A sheath may be capped at one end or open at both ends, depending upon the manner in which it is to be used. Furthermore, openings may be provided along the edges of the sheath to match corresponding openings in the core element covered by the sheath.

While I have described and illustrated certain preferred embodiments of my invention, it is to be understood that other obvious variations will become apparent to those skilled in the art and will still be within the scope of my invention which is limited only by the following claims.

I claim:

1. A hollow fence element for use in combination with a wood core picket fence element and comprising a hollow plastic rigid tubular sheath having a length co-extensive with the length of the fence element, having a closed tapered end congruent with the pointed end of the picket and an open end, and having interior dimensions which are congruent with the exterior dimensions of the core element such that the sheath can be slipped over the pointed end of the core element and surround the exterior surface of the core element.

2. The fence element defined in claim 1 wherein said sheath is of molded synthetic plastic having color pigment molded in the exterior surface thereof.

3. In combination, an unfinished wood core picket fence element, and a finished hollow synthetic plastic rigid tubular sheath fitted over said core element, having a length co-extensive with that of the fence element, having a closed tapered end congruent with the pointed end of the picket and an open end, and having internal dimensions which are congruent with the external dimensions of said core element.

4. The combination of claim 3 wherein said sheath has color pigment molded in the exterior surface thereof.

* * * * *